US007343740B2

(12) United States Patent
Sakai et al.

(10) Patent No.: US 7,343,740 B2
(45) Date of Patent: Mar. 18, 2008

(54) ORIFICE ELEMENT WITH INTEGRATED FILTER, SLOW RETURN VALVE, AND HYDRAULIC DRIVE UNIT

(75) Inventors: Yoshitake Sakai, Toki (JP); Osamu Sato, Minokamo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 84 days.

(21) Appl. No.: 11/371,314

(22) Filed: Mar. 7, 2006

(65) Prior Publication Data

US 2006/0242957 A1 Nov. 2, 2006

(30) Foreign Application Priority Data

Mar. 14, 2005 (JP) ..... 2005-070748

(51) Int. Cl.
*F15B 11/08* (2006.01)
*B66F 9/22* (2006.01)

(52) U.S. Cl. ..... 60/453; 60/454

(58) Field of Classification Search ..... 60/453, 60/454, 476; 210/130, 137, 97, 167.01
See application file for complete search history.

(56) References Cited

U.S. PATENT DOCUMENTS 3,640,066 A * 2/1972 Marshall et al. ..... 60/466
5,766,469 A * 6/1998 Boast et al. ..... 210/335
7,069,675 B2 * 7/2006 Nishi et al. ..... 37/348

FOREIGN PATENT DOCUMENTS

JP 07259810 A * 10/1995
JP 2858168 B2 12/1998

* cited by examiner

*Primary Examiner*—Thomas E. Lazo
(74) *Attorney, Agent, or Firm*—Hiroe & Associates; Michael L. Crapenhoft

(57) ABSTRACT

A filter-integrated orifice element is provided which can reduce manufacturing costs and assembling costs in a hydraulic circuit for which size reduction is desirable. A filter-integrated orifice element is obtained by integrating a filter for removing an obstacle which could block an orifice with an orifice member. The filter-integrated orifice element may be used in a slow return valve in a hydraulic circuit.

6 Claims, 7 Drawing Sheets

ORIFICE ELEMENT WITH INTEGRATED FILTER, SLOW RETURN VALVE, AND HYDRAULIC DRIVE UNIT

BACKGROUND OF THE INVENTION

The present invention relates to valve and filter mechanisms useful in machinery that employs a hydraulic circuit. More specifically, the invention provides an orifice element with an integrated filter. The orifice element is useful for throttling a flow rate of hydraulic oil in one direction in a hydraulic circuit. The hydraulic circuit may be used, for example, in a hydraulic drive unit for independently applying a driving force generated by hydraulic pressure to a driven body. A slow return valve in the hydraulic circuit regulates the flow rate of hydraulic oil flowing out of a hydraulic actuator that generates the driving force for a hydraulic drive unit that uses the hydraulic circuit.

A hydraulic drive unit that conveniently provides a driving force created by oil pressure without the need to lay hydraulic pipes if only an electric power source is present has been used, for example, to drive and lift a working element in an agricultural vehicle with respect to cultivated ground. Such drive units are expected to see continued and wider application in this and other fields.

SUMMARY OF THE INVENTION

A filter-integrated orifice element that embodies the present invention includes a filter for removing an obstacle that might otherwise block an orifice in an orifice member that is integrated with the filter. The filter-integrated orifice element may be used in a hydraulic circuit.

A slow return valve according to invention may include such a filter-integrated orifice element.

A hydraulic drive unit according to the invention may include a slow return valve that includes such a filter-integrated orifice element The filter-integrated orifice element of the invention provides a simple and economical assembly with a reduced number of parts, and one which requires fewer assembly steps to produce it. Also, since the filter can be manufactured over the entire face of the orifice element, which makes the filter area larger, the filter efficiency is improved and the life of the filter is prolonged.

Since a slow return valve of the present invention is provided with a filter-integrated orifice element having such advantages, these same advantages are also present in the slow return valve.

Also, since a hydraulic drive unit of the present invention is provided with a slow return valve that has such advantages, those same advantages are also present in the hydraulic drive unit.

BRIEF DESCRIPTION OF THE DRAWINGS

The invention will be understood best by reference to the description provided herein, in conjunction with the accompanying drawings, in which:

FIG. 1(*b*) is a section view on section line AA of FIG. 1(*a*);

FIG. 1(*c*) is a sectional view illustrating parts of the slow return valve under a free flow condition;

FIG. 2(*b*) is a sectional view showing parts of another embodiment;

FIG. 5(*b*) is sectional view on section line BB of FIG. 5(*a*);

FIG. 5(*c*) is a sectional view on section line CC of FIG. 5(*b*);

FIG. 7(*b*) is a section view on section line DD of FIG. 5(*a*); and

FIG. 7(*c*) illustrates parts of the slow return valve of FIG. 7(*b*) under a free flow condition.

DETAILED DESCRIPTION OF PREFERRED EMBODIMENTS

A preferred embodiment of the present invention will be described below referring to the attached drawings.

Figure 6:
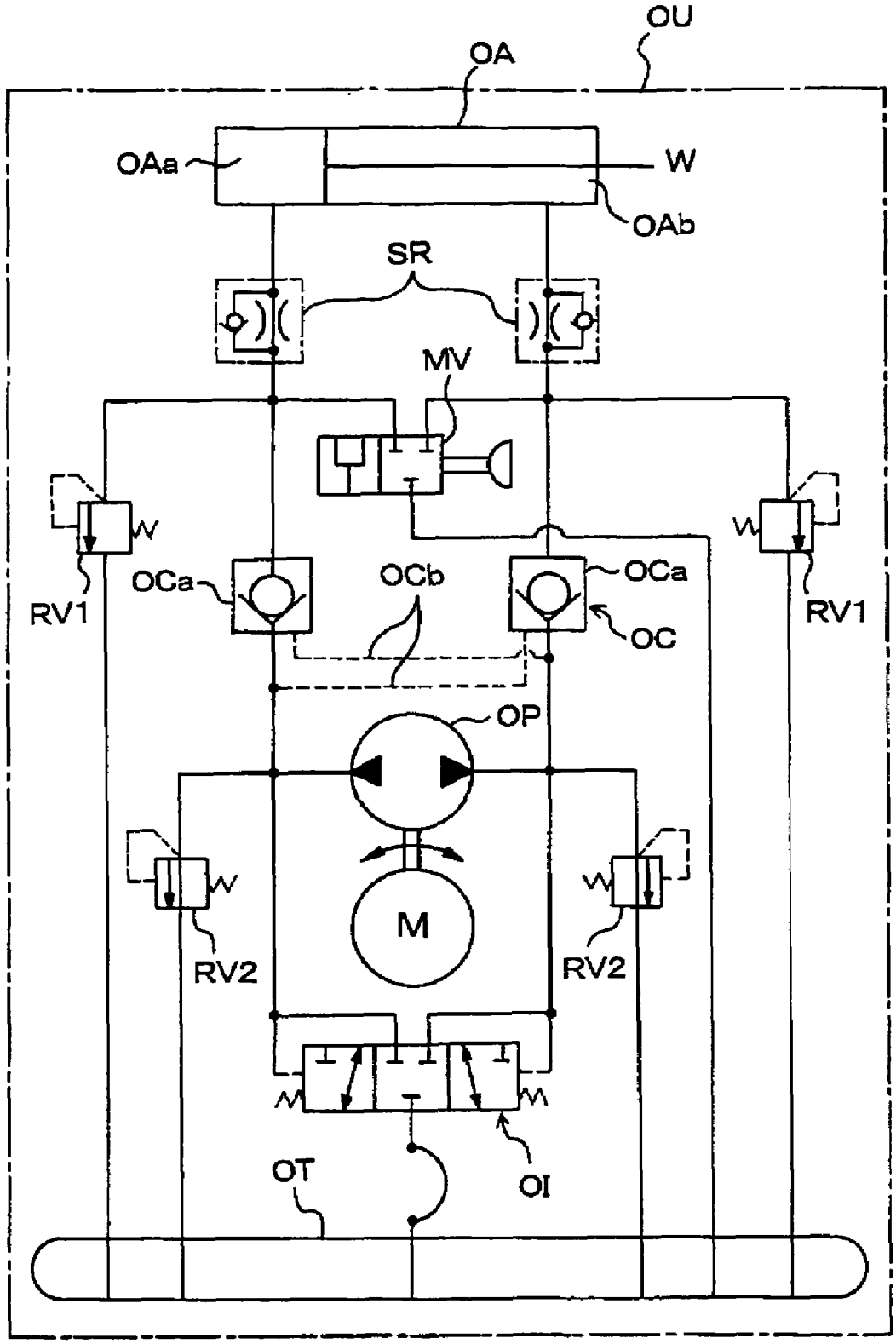
FIG. 6 is a hydraulic circuit diagram showing the basic elements of a hydraulic drive unit.

FIG. 6 is a hydraulic circuit diagram that illustrates the basic configuration of a hydraulic drive unit.

A hydraulic drive unit OU is configured to deliver a driving force generated by hydraulic pressure in the unit to a driven body W. This driving force is generated independently by the circulation of hydraulic oil in a closed system. The hydraulic drive unit OU includes a hydraulic pump OP that pumps the hydraulic oil in both normal and reverse directions. The hydraulic pump OP is driven by a normal and reverse rotating motor M. A hydraulic actuator OA (in this example, a hydraulic cylinder) is driven by the hydraulic oil to generate the driving force. A tank OT stores the hydraulic oil in a closed space. An operate check valve OC controls the flow of the hydraulic oil in both the normal and reverse directions between the hydraulic pump OP and the hydraulic actuator OA, and a switching valve OI controls the flow of the hydraulic oil in both the normal and reverse directions between the hydraulic pump OP and the tank OT.

The operate check valve OC includes a pair of check valves OCa that control the flow of hydraulic oil between the hydraulic pump OP and the hydraulic actuator OA, and a pair of pilot lines OCb that pilot the hydraulic pressure from either of the check valves OCa to the other.

One of this pair of check valves OCa is provided in a pipe line that connects one port of the hydraulic pump OP to a bottom-side oil chamber OAa of the hydraulic actuator OA. The other is located in a pipe line that connects the other port of the hydraulic pump OP to a rod-side oil chamber OAb of the hydraulic actuator OA.

The switching valve OI operates to selectively connect and disconnect the pipe lines between the hydraulic pump OP, the bottom-side oil chamber OAa of the hydraulic actuator OA, the actuator's rod-side oil chamber OAb, and the tank OT.

In the explanation below, in some cases the left one of the left- and right-side pair of check valves OCa in FIG. 6 is referred to as the bottom-side check valve in reference to the hydraulic oil going into and out of the bottom-side oil chamber OAa of the hydraulic actuator OA. The right-side valve may be referred to as the rod-side valve in reference to the hydraulic oil going into and out of the rod-side oil chamber OAb. Similarly for the ports of the hydraulic pump OP, the left port is called the bottom-side port and the right port the rod-side port in some cases in the following discussion.

When the hydraulic pump OP of the hydraulic drive unit OU is stopped, the outflow of hydraulic oil from both the bottom-side oil chamber OAa and the rod-side oil chamber OAb of the hydraulic actuator OA is inhibited by the operate check valves OC so that the hydraulic actuator OA is held stationary against an external force applied to it.

When the hydraulic pump OP is rotated so that hydraulic oil is discharged to the bottom-side port, the hydraulic oil, passes through the bottom-side check valve OCa and into the bottom-side oil chamber OAa. At the same time, the rod-side check valve OCa is pushed open by the hydraulic oil pressure in the bottom-side pilot line OCb. The outflow of hydraulic oil from the rod-side oil chamber OAb to the hydraulic pump OP is thereby allowed, and a flow of hydraulic oil circulating clockwise between the hydraulic pump OP and the hydraulic actuator OA is thus created. This generates a driving force to extend the hydraulic actuator OA.

As the hydraulic actuator extends, and remembering that the hydraulic actuator OA in FIG. 6 is a hydraulic cylinder, the amount of hydraulic oil that flows out of the rod-side oil chamber OAb is less than the amount of hydraulic oil that flows into the bottom-side oil chamber OAa by an amount equal to the moving volume of the rod of the piston being driven inside the hydraulic cylinder. Switching valve OI driven by the higher oil pressure in the hydraulic oil at the bottom side of the unit, switches over to connect the pipe lines between the rod-side oil chamber OAb and the tank OT, thereby allowing hydraulic oil to flow from the tank and into the rod-side oil chamber to make up for this shortfall.

When, on the other hand, the hydraulic pump OP is rotated so that hydraulic oil is discharged through the rod-side port, a circulating flow of hydraulic oil reverse to the above-described flow is created, and this generates a driving force to contract the hydraulic actuator OA. An excess of hydraulic oil then flows from the bottom-side oil chamber OAa to the hydraulic pump OP (in comparison with the oil flowing from the pump to the top-side oil chamber of the actuator). In this case, though, since the pipe lines between the bottom-side oil chamber OAa and the tank OT are connected to one another other, the excess hydraulic oil is simply returned to the tank OT.

The amount of hydraulic oil in the enclosed tank OT thus increases or decreases somewhat depending on the position at that moment of the piston inside the hydraulic cylinder of the hydraulic actuator OA. The pressure of the gas sealed in the tank OT will thus fluctuate somewhat, but where the amount of the gas sealed inside the tank is proper, the operation of the hydraulic drive unit OU will not affected by these fluctuations in gas pressure.

The functioning of the hydraulic drive unit OU is thus achieved and maintained using a hydraulic actuator OA in a closed system in which there is a variable difference in the amount of hydraulic oil that goes into and out of the actuator.

This hydraulic drive unit OU includes the following components in addition to the basic components described above.

A slow return valve SR is located in each of the pipe lines: (1) between the bottom-side oil chamber OAa and the bottom-side check valve OCa of the operate check valve OC, and (2) between the rod-side oil chamber OAb of the hydraulic actuator OA and the rod-side check valve OCa. These slow return valves SR throttle the flow of hydraulic oil from the respective oil chambers OAa and OAb and to either of the two check valves OCa of the operate check valve OC.

The slow return valves SR prevent hunting that might otherwise occur when an external force is exerted by a driven body W during operation of the hydraulic pump OP.

Pipe lines provided with relief valves RV1 branch to the tank OT from the pipe lines between the slow return valves SR and the check valves OCa. Similar pipe lines provided with relief valves RV2 branch to the tank OT from the pipe lines between each side of the hydraulic pump OP and the corresponding check valves OCa on the bottom and top sides of the operate check valve OC.

These relief valves RV1 and RV2 let excess hydraulic oil escape to the oil tank OT when an abnormal pressure is for some reason produced in the main pipe line.

A further pipe line provided with an emergency manual valve MV branches to the tank OT from the pipe lines between the slow return valves SR on the rod side and the bottom side and the check valves OCa. When the hydraulic pump OP is stopped by the absence of electric power, for example, oil in the pipe lines of the bottom-side oil chamber OAa and the rod-side oil chamber OAb of the hydraulic actuator OA can be released to the oil tank OT so that the hydraulic actuator OA can be operated manually.

A hydraulic drive unit OU having the configuration described above ensures safety, reliability, and accident avoidance to prevent damage to the unit OU while properly achieving the basic function thereof, even in a case where an emergency arises. The slow return valves SR play an important role in the proper functioning of such a system.

Figure 7A:
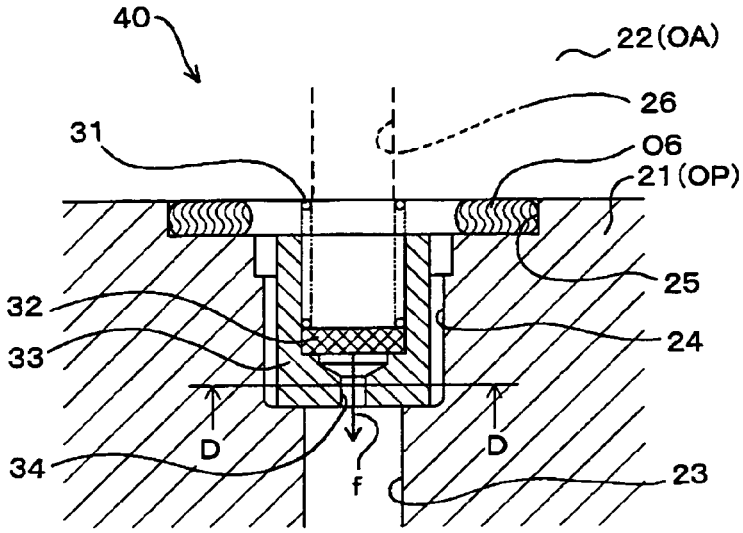
FIG. 7(*a*) illustrates parts of a slow return valve under a controlled-flow condition.
Figure 7B:
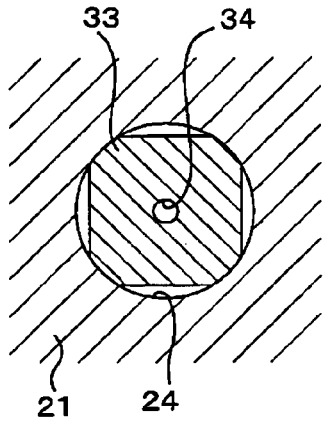
Figure 7C:
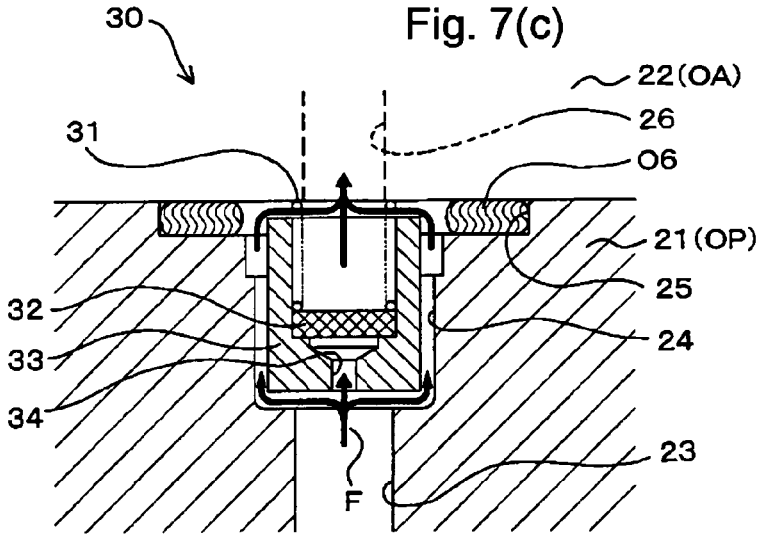

FIGS. 7(*a*)-7(*c*) illustrate structural elements of a slow return valve of a kind that might find use in hydraulic systems of the type described above. FIG. 7(*a*) is a sectional view of a part of the valve under a controlled flow condition, FIG. 7(*b*) is a section view on lines DD of FIG. 7(*a*), and FIG. 7(*c*) is a sectional view of a part of the valve under a free flow condition.

The slow return valve 40 shown in FIGS. 7(*a*)-7(*c*) represents an improvement by the applicants over the valve denoted by reference character SV in FIG. 5 of Japanese Patent No. 2858168. The improved valve 40 shown here in FIGS. 7(*a*)-7(*c*) includes a filter 32 for trapping and removing foreign materials from a fluid flowing through the valve, and a spring 31 that urges the filter 32 into constant close contact with an orifice element 33.

The slow return valve 40 includes an orifice element 33 with an orifice 34, the filter 32, which traps and removes from the fluid flow particulate bodies that might otherwise block or restrict the flow of fluid through the orifice 34, and the spring 31 that holds the filter 32 in place against one side of the orifice element 33.

The slow return valve 40 is located between a connection portion of a housing 21 on the side of the hydraulic pump OP in FIG. 6, and a housing 22 on the side of the hydraulic actuator OA.

More specifically, the orifice element 33 is located in a borehole 24 whose diameter is somewhat larger than that of a pipe line 23 in the housing 21, so that the outer periphery of the orifice element 33 can fit into but slide inside the borehole 24. An even larger diameter connection hole 25 is present in the housing 21 outside of the orifice element 33.

An O-ring O6 is fitted inside the inner circumference of the connection hole 25 so that an oil-tight connection with the actuator-side housing 22 can be maintained.

A pipe line 26 is provided in the housing 22 on the side of the hydraulic actuator OA and connected with the connection hole 25 of pump-side housing 21.

The orifice element 33 is a cylindrical body with one open end, and a small diameter orifice 34 at the center of the other, closed end. The diameter of the orifice 34 may be, for example, 0.8 millimeters in a slow return valve for use in a hydraulic drive unit of the type described above.

In this example of the slow return valve 40, when hydraulic oil is flowing from the hydraulic actuator OA side to the hydraulic pump side OP as shown in FIG. 7(*a*), the pipe line 23 is mostly closed by the orifice element 33, and only a relatively low-rate, controlled flow f is allowed through the orifice 34.

When hydraulic oil is flowing as depicted in FIG. 7(*c*), on the other hand, from the hydraulic pump side OP to the hydraulic actuator OA side, the face of the orifice element 33 is moved away from the opening of the pipe line 23, and the hydraulic oil is thereby allowed to pass between the flat faces on the outer periphery of the orifice element and the inner circumference of the borehole 24—(see FIG. 7(*b*))—in a relatively high-rate, free flow condition F.

The slow return valve 40 thus performs the functions of the slow return valve SR described above in connection with FIG. 6.

Because the orifice 34 in this slow return valve 40 is small, the filter 32 that prevents blockage of the orifice and the spring 31 that urges the filter 32 into close contact with the surface around the orifice 34 under the controlled flow condition f are required parts of the orifice of this valve assembly.

For a small diameter orifice like that described above, the outer diameter of the orifice element 33 will need to be about 4 millimeters and the outer diameters of the filter 32 and the spring 31 about 3 millimeters. There are then certain difficulties and high costs associated with manufacturing and assembling products of this size.

Similar problems exist, naturally, in the construction of an orifice element of this type in a hydraulic drive unit of the type described above, as well as in similar small or super-small hydraulic circuits.

Japanese Patent No. 2858168 does not recognize problems of this type and does not suggest solutions for such problems either.

The embodiments described below have been devised with an aim to solving the problems mentioned above by providing an orifice element with an integrated filter element, in which manufacturing and assembly costs can be reduced in reduced-size hydraulic circuits and hydraulic drive units that include a slow return valve that uses an orifice element of this type.

Figure 1A:
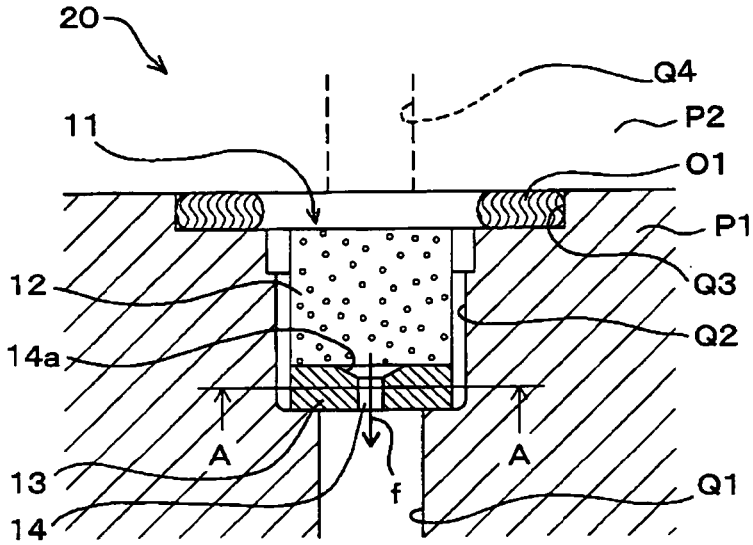
FIG. 1(*a*) is a sectional view illustrating parts of a slow return valve according to the invention under a controlled flow condition.
Figure 1B:
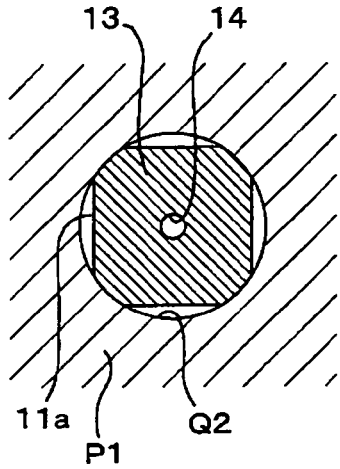
Figure 1C:
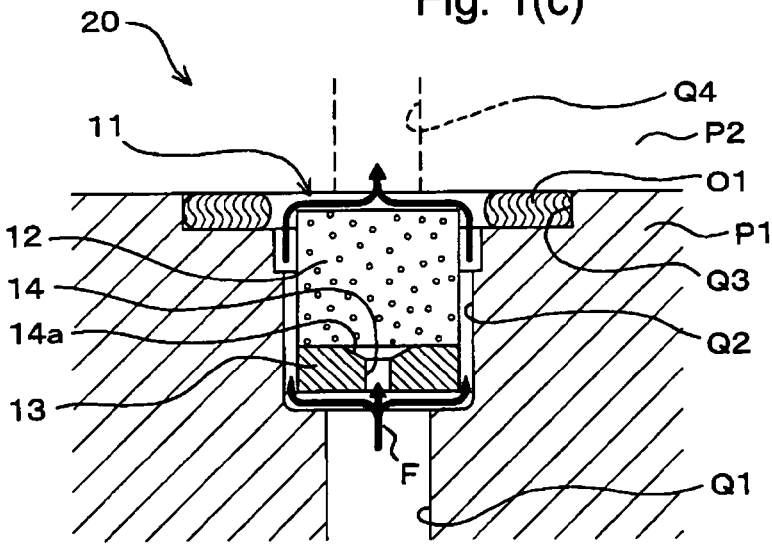

FIG. 1 depicts structures in an embodiment of a slow return valve that includes a filter-integrated orifice element according to the present invention. FIG. 1(*a*) is a section view of the slow return valve in a controlled flow state, FIG. 1(*b*) is a section view on lines AA of FIG. 1(*a*), and FIG. 1(*c*) is a section view of the slow return valve in a free-flow condition.

The slow return valve 20 includes a filter-integrated orifice element 11. The orifice element 11 is located and held between a connection portion of a housing P1 corresponding to the hydraulic pump OP side shown in FIG. 6, and a housing P2 corresponding to the hydraulic actuator OA side. The flow of a hydraulic oil from the housing P1 to the housing P2 is referred to as a free flow F, and as a controlled flow f in the reverse direction.

More specifically, the orifice element 11 is located inside a borehole Q2, whose diameter is somewhat greater than that of a pipe line Q1 inside the housing P1, so that the outer periphery of the orifice element is slideable inside the inner circumference of the borehole Q2. An open larger diameter connection hole Q3 is present on the outside of the borehole Q2.

An O-ring O1 is fitted inside the inner circumference of the connection hole Q3, and the oil-tight connection with the housing P2 is thereby maintained.

On the housing P2 corresponding to the hydraulic actuator OA side, a pipe line Q4 is connected to the connection hole Q3 of the housing P1 that corresponds to the hydraulic pump OP.

The description here assumes a general example of a hydraulic circuit that includes the filter-integrated orifice element 11 and the slow return valve 20 of the invention. General alphanumeric symbols are thus used as reference characters for the locations and portions where the orifice element 11 and the slow return valve 20 are located.

The filter-integrated orifice element 11 includes an orifice member it in the form of an orifice plate 13 that is used in this hydraulic circuit in conjunction with an integrated filter 12, which filters obstacles that might otherwise block the orifice 14 in the orifice plate 13.

More specifically, in this filter-integrated orifice element 11, the integrated filter 12 is a porous body that is integrated with the orifice plate 13 after filter 12 is formed.

A porous sintered body is used as a material in the filter 12 in this embodiment. This sintered body may be, for example, a stainless mesh laminated body or the like. The orifice plate 13 can be manufactured by machining from a metal material.

These two constituent elements are integrated with each other by connecting them together by means such as brazing or soldering. A taper escape 14*a* is provided on the filter 12 side of the orifice 14, so that an effective orifice diameter can be insured even some excess brazing material is present in the assembly.

Also, the sizes of the outer peripheries of the filter 12 and the orifice plate 13 are the same. A small clearance between these outer peripheries and the inner circumference of the borehole Q2 of the housing P1 is provided, in the same manner as is described above, so that the filter-integrated orifice element 11 can slide vertically within the containing hole Q2 in FIGS. 1(*a*) and 1(*b*).

The outer peripheries of the filter 12 and the orifice plate 13 include partially flat portions 11*a*.

With this configuration of the slow return valve 20 the pipe line Q1 is closed by the orifice element 11 in the case of a controlled flow condition f from the housing P2 on the hydraulic actuator OA side to the housing P1 on the hydraulic pump OP side as is illustrated in FIG. 1(*a*). Under these conditions, only a limited, controlled flow occurs through the orifice 14.

FIG. 1(*c*), on the other hand, illustrates a free flow F from the housing P1 on the hydraulic pump OP side to the housing P2 on the hydraulic actuator OA side. Under this flow condition, the hydraulic oil flows through the gaps between the flat portions 11*a* of the orifice element 11 and the inner diameter of the borehole Q2 (see FIG. 1(*b*)). The hydraulic oil can thus flow relatively freely, because it is not constrained to flow only through the small orifice 14 in the orifice element 11.

This slow return valve 20 thus performs the same function as the slow return valve SR described above in connection with FIG. 6.

When a slow return valve 20 of this type is used, it is only necessary to position the filter-integrated orifice element 11 inside the borehole Q2. It is not necessary to assemble a small orifice element, a filter, etc. sequentially, and the number of assembly steps is thereby reduced.

The filter 12 and the orifice plate 13 can also be made to have the same outer shape, moreover, and the orifice plate 13 does not need to have a special hole machined in it to contain the filter, as was previously the case. This too reduces the number of manufacturing processes required to construct the valve. The spring that was previously used to bring the filter and the orifice element into close contact with one another other is also not now required, and the number of parts in the assembly is thereby reduced.

The filter-integrated orifice assembly 11 and the slow return valve 20 benefit thereby from a possible reduction in size, manufacturing costs, and assembly costs.

In this embodiment, too, the volume of the filter 12 can be made larger, which allows the filter function to be exerted over a wider area or volume. The performance of the filter and its working life can thereby be increased.

Figure 2A:
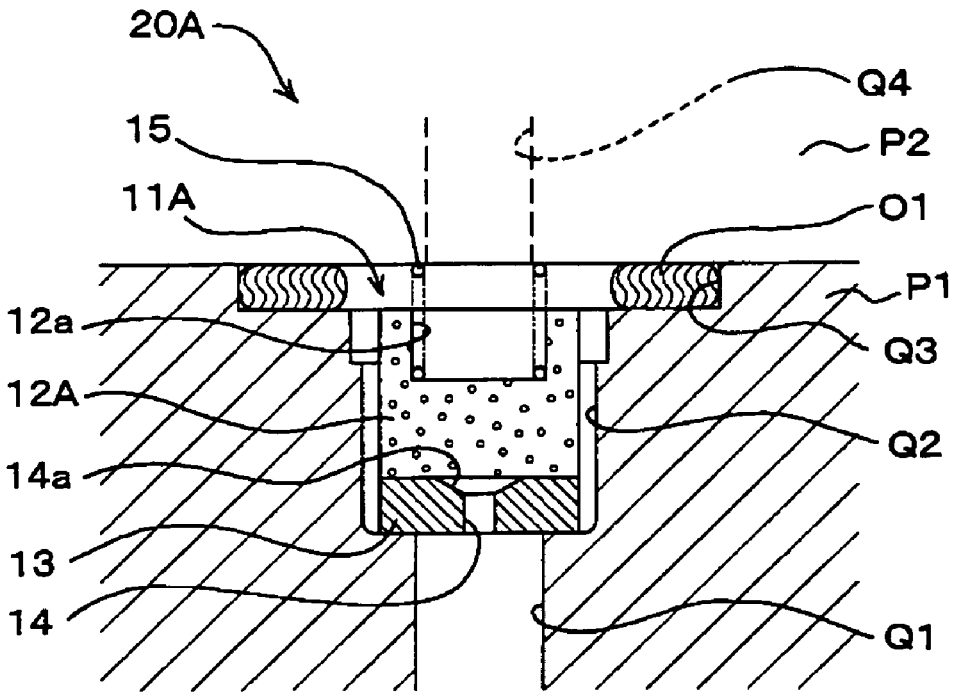
FIG. 2(*a*) is a sectional view showing parts of an alternative embodiment of a slow return valve according to the invention.
Figure 2B:
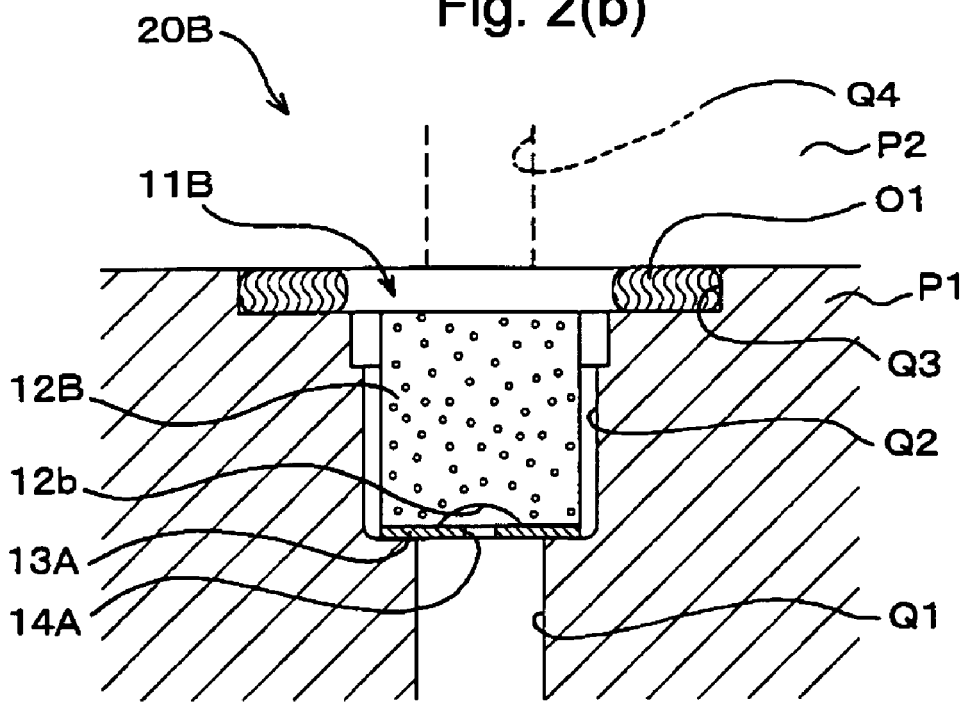
Figure 3A:
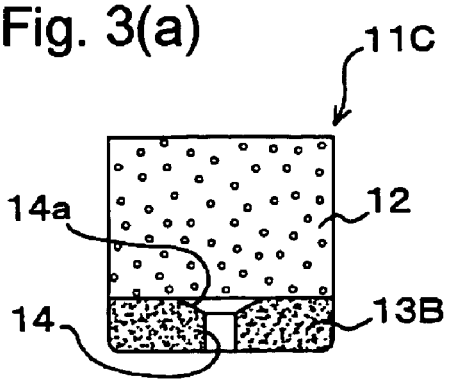
FIGS. 3(*a*)-3(*f*) are sectional views illustrating alternative embodiments of filter-integrated orifice elements according to the invention.
Figure 3B:
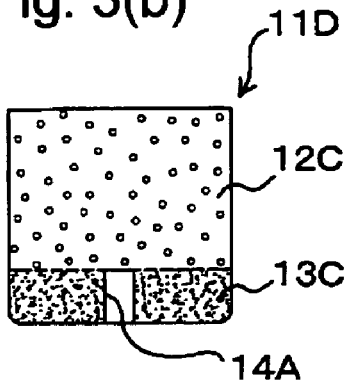
Figure 3C:
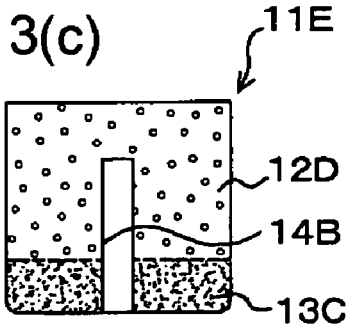
Figure 3D:
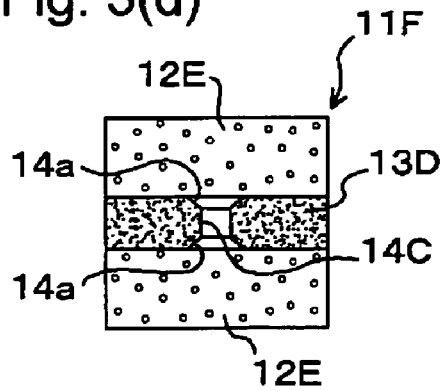
Figure 3E:
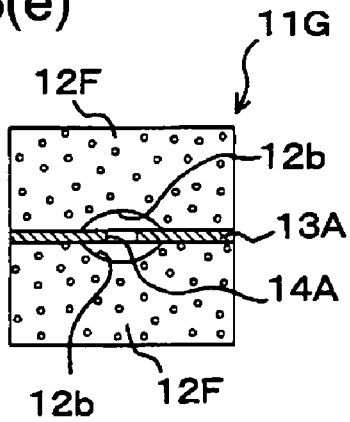
Figure 3F:
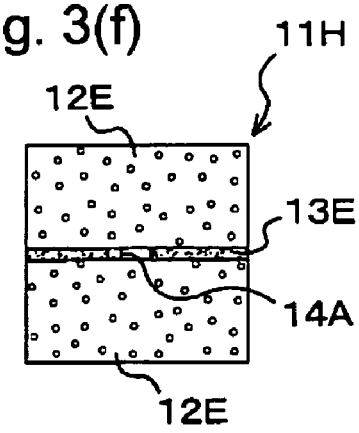

FIGS. 2(*a*) and 2(*b*) are sectional views illustrating structures in another embodiment of a slow return valve that uses a filter-integrated orifice element according to the invention. The following description uses the same reference characters to refer to the portions of the assembly that are the same as those mentioned previously, in order to avoid duplicated explanation. Also, when a collective body of parts is assigned a separate reference character, only the character that refers to the collective body may be shown to avoid undue complexity in the figures.

The slow return valve 20A in FIG. 2(*a*) differs from the slow return valve 20 in FIG. 1 in that a spring receiving recess 12*a* is provided on a filter 12A of a filter integrated orifice element 11A. A spring 15 is also provided between this spring receiving recess 12*a* and the housing P2. The spring 15 urges the orifice 11A towards a position that blocks the pipe line Q1 of the housing P1.

This spring 15 is not required to bring the filter 12A of the filter-integrated orifice element 11A into close contact with the orifice plate 13, but rather to urge the orifice element 11A in the direction of the pipe line Q1. The spring should be selected to provide a force small enough so as not to unduly resist flow in the free flow direction.

The spring 15 immediately closes the pipe line Q1 with the orifice element 11A when flow switches from the free flow to the controlled flow condition, and thereby reduces noise that might otherwise be generated by the orifice's rapid closure of the pipe line Q1 upon initiation of the controlled flow condition.

In this embodiment, the filter-integrated orifice element 11A and the slow return valve 20A perform functions similar to those of the filter-integrated orifice element 11 and the slow return valve 20 shown in FIG. 1, in combination with the additional effect of the above-mentioned spring 15.

The slow return valve 20B shown in FIG. 2(*b*) differs in comparison with the slow return valve 20 of FIG. 1 in that an orifice plate 13A used in the filter-integrated orifice element 11B has the structural and functional strength required of the orifice provided in large part by the material structure of the filter 12B.

As a result, and as the figure indicates, the orifice plate 13A is integrated with the filter 12B, and the flat face on the side that closes the pipe line Q1 is maintained even with a the minimum thickness that ensures an orifice 14A.

The fact that the thickness of the orifice plate 13A can be reduced in this way means that the length of the orifice 14A can be made shorter, and by this, the length of a throttle portion can be reduced as compared with the sectional dimension so that the influence of viscosity of the hydraulic oil is reduced accordingly, which facilitates design of the orifice.

An escape recess 12*b* is provided on the filter 12B to avoid the adverse effect of excessive brazing material that might remain after the filter 12B and the orifice plate 13A are integrated together. The same function is performed by the taper escape 14*a* of the orifice 14 in FIG. 2(*a*).

FIGS. 3(*a*) to 3(*f*) are longitudinal section views illustrating structures of other embodiments of filter-integrated orifice elements according to the invention.

A filter-integrated orifice element 11C in FIG. 3(*a*) differs from the filter integrated orifice element 11 in FIG. 1 in that the orifice plate 13B is a sintered body that does not allow the hydraulic oil to pass through it. The two embodiments are like one another in that the filter 12 and the orifice plate 13B are integrated with each other after their respective formations.

With the filter-integrated orifice 11C of this embodiment, since the orifice 13B can be molded without machining, the number of manufacturing processes can be further reduced depending on the number to be produced.

A filter-integrated orifice element 11D in FIG. 3(*b*) is different from the filter-integrated orifice element 11 in FIG. 1 in that a filter 12C is of a porous sintered body with a predetermined porosity, the orifice plate 13C is a sintered body that does not allow hydraulic oil to pass through it, and the filter 12C and the orifice plate 13C are sintered and integrated together.

More specifically, after the filter 12C and the orifice plate 13C are sintered and molded as individual elements, the orifice element 11D is integrally sintered and molded by diffusion bonding, which is one method of sintering the two parts of the orifice element together.

According to the filter-integrated orifice element 11D of this embodiment, since formation of the orifice element is possible without machining or the like, the number of required processes can be further reduced.

A filter-integrated orifice element 11E in FIG. 3(*c*) differs from the filter-integrated orifice element 11D in FIG. 3(*b*) in that an orifice 14B provided through the orifice plate 13C extends some distance inside of the filter 12D. The manufacturing process for this element is otherwise the same.

According to the filter-integrated orifice element 11E in this embodiment, in addition to the effect of the above-mentioned filter-integrated orifice element 11D, the orifice 14B and the filter 12D are brought into contact with each other over a wider area, with the effect that the filter efficiency is increased and the possibility that the orifice 14B will be is blocked is reduced.

A filter-integrated orifice element 11F in FIG. 3(*d*) is like the filter-integrated orifice element 11C in FIG. 3(*a*) in that the orifice plate 13D is sintered and formed with a sintered body that does not allow the hydraulic oil to pass through it, and in that the filter 12E and the orifice plate 13D are integrated with one another after their respective formations with a method similar to that of the filter-integrated orifice element 11 in FIG. 1. These differ, though, in that the filter 12E is provided on both sides of the orifice plate 13B in a sandwiched configuration.

The filter-integrated orifice element 11F of this embodiment filters flow in the both directions through the orifice element 11F.

A filter-integrated orifice element 11G in FIG. 3(*e*) is like the filter-integrated orifice element 11F in FIG. 3(*d*), in that the filter 12F is provided both before and after the orifice plate 13A in a sandwich configuration, and in that the parts are integrated, but different in that the orifice plate 13A at the center like the orifice plate 13A in FIG. 2(*b*), and in that escape recesses 12*b* similar to the one in the filter 12*b* in FIG. 2(*b*) are provided in the filter 12F.

The filter-integrated orifice element 11G in this embodiment combines the functions of the filter-integrated orifice element 11B in FIG. 2(*b*) with those of the filter-integrated orifice element 11F.

A filter-integrated orifice element 11H in FIG. 3(*f*) is like the filter-integrated orifice element 11G in FIG. 3(*e*) in that the filter 12E is provided both before and after the orifice plate 13E in a sandwich configuration, and in that the orifice plate 13E has its structural and functional strength augmented and provided in large part by the structure of the filter 12E.

This filter-integrated orifice element 11H is different from the filter integrated orifice 11G in FIG. 3(*e*), on the other hand, in that the orifice plate 13E at the center is sintered and formed as a sintered body that does not allow hydraulic oil to pass through it (as is also the case with the orifice plate 13C in FIG. 3(*b*)), and in that this orifice plate 13E and both the filters 12E are integrally sintered and molded together.

In the filter-integrated orifice element 11H of this embodiment, in addition to the effect of the above filter-integrated orifice element 11H, the function of the filter-integrated orifice element 11D in FIG. 3(*b*) is also performed.

Figure 4:
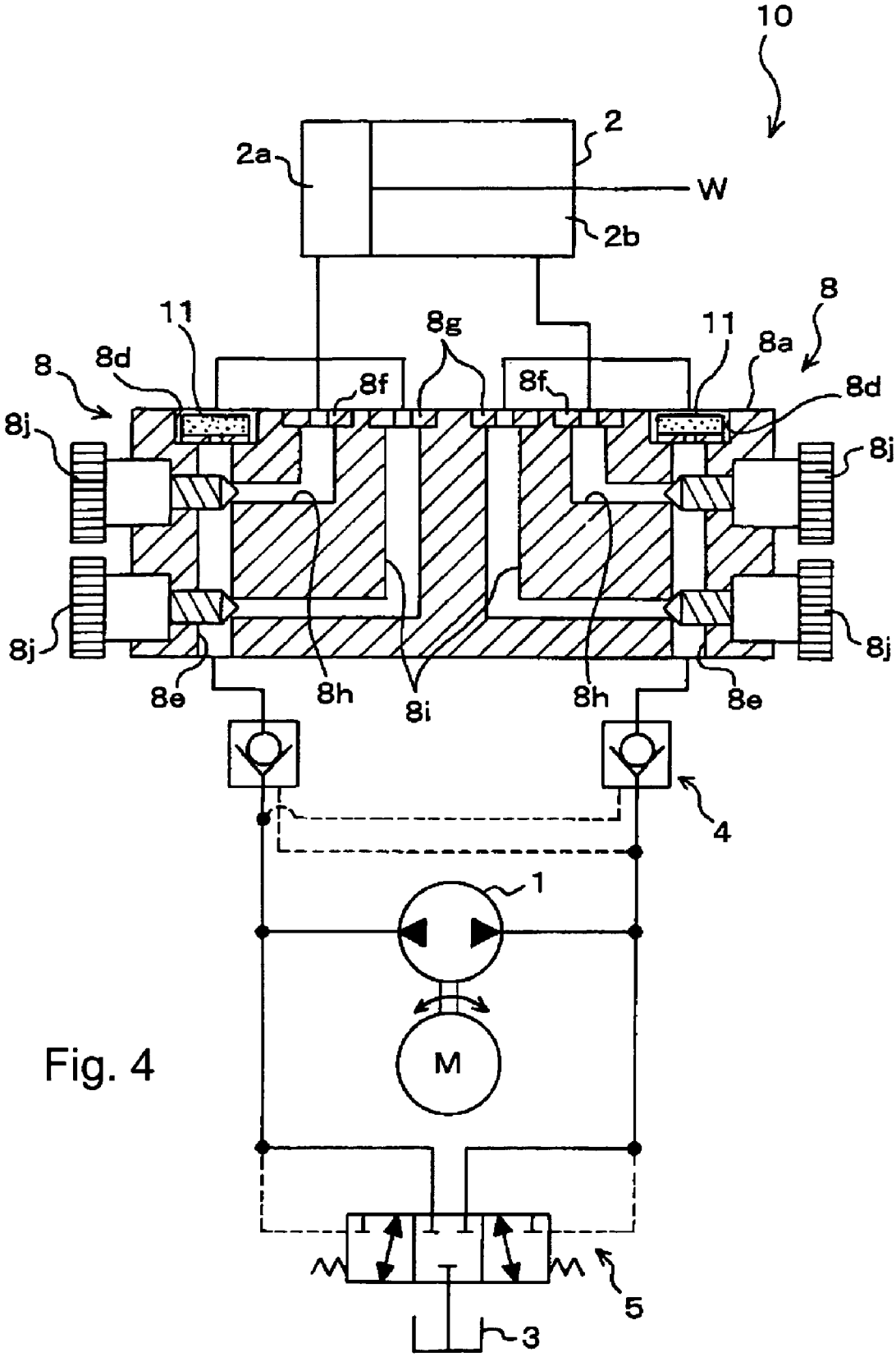
FIG. 4 is a conceptual block diagram showing an example of a hydraulic drive unit that includes an adjustable slow return valve provided with the filter-integrated orifice element of the present invention.

FIG. 4 is a conceptual block diagram showing an example of a hydraulic drive unit that includes a selective slow return valve provided with a filter-integrated orifice element according to the invention.

The hydraulic drive unit 10 can be used in a machine that requires a convenient and independent driving force created by oil pressure, for example, to lift a work element on a special agricultural vehicle with respect to cultivated ground. A slow return valve 8 in the hydraulic drive unit 10 is used to throttle a flow rate of hydraulic oil flowing out of a hydraulic actuator 2. The hydraulic actuator 2 is used to generate the driving force in this hydraulic drive unit 10.

The unit 10 includes a hydraulic pump 1 driven by an electric motor M to pump hydraulic oil in normal and reverse directions. A hydraulic cylinder 2 serves as a hydraulic actuator, and is powered by the hydraulic oil to deliver a driving force to a driven body W. A tank 3 stores hydraulic oil in a closed space. An operate check valve 4 controls the flow of hydraulic oil between the hydraulic pump 1 and the hydraulic cylinder 2 in both the normal and reverse directions. A switching valve 5 controls the flow of hydraulic oil in both the normal and reverse directions between the hydraulic pump 1 and the tank 3. A slow return valve 8 in this embodiment is adjustable and thus can be selectively set.

The basic functions and mutual relations of the hydraulic pump 1, hydraulic cylinder 2, tank 3, operate check valve 4, and switching valve 5 in this embodiment are generally the same as those of the hydraulic pump OP, hydraulic actuator OA, tank OT, operate check valve OC, and switching valve OI in the hydraulic drive unit OU in the system described above and illustrated in FIG. 6, and duplicative description of these elements will thus be omitted. Reference symbol 2*a* refers to a bottom-side oil chamber of the hydraulic cylinder 2, and symbol 2*b* to a rod-side oil chamber.

The relief valves RV1 and RV2 in the hydraulic circuit diagram of FIG. 6 are not shown here, but may be provided as necessary.

A pair of slow return valves 8 are included in the system shown in FIG. 4. These valves are located in an added housing 8*a* that contains the parts required for throttling the hydraulic oil flow out of both the bottom-side oil chamber 2*a* and the rod-side oil chamber 2*b* of the hydraulic cylinder 2.

The additional housing 8*a* is provided with main valve pipe lines 8*e* that run through it so that the pipe lines on the bottom side and the rod side between the hydraulic cylinder 2 and the operate check valve 4 are connected to each other. Additional valve pipe lines 8*h* and 8*i* branch from the middle of these main valve pipe lines 8*e*, and are connected at the hydraulic cylinder 2 side as shown.

The construction of the main valve pipe line 8*e* is the same as that of the conventional slow return valve and an orifice element 11 is provided to throttle the flow rate of hydraulic oil flowing out of the hydraulic cylinder 2. A recess 8*d* is provided on the hydraulic cylinder 2 side of the main valve pipe line 8*e* to contain and hold the orifice element 11 in place.

Here, as is implied by the use of the reference number 11, the slow return valve 8 uses a filter-integrated orifice element 11 according to the invention as its orifice element. Therefore, the functions and advantages of this orifice element 11 are thus present in this slow return valve 8.

Thus, for example, no separate filter element is required (apart from the integrated filter element 12) to prevent clogging of the orifice 14 in the filter-integrated orifice element 11 of this slow return valve 8.

It is also possible to provide any of the above-mentioned various filter-integrated orifice elements 11A to 11E in place of the filter integrated orifice 11, and in that case, the various effects and advantages of those filter-integrated orifice elements may be realized as well.

Additional orifices 8*f* and 8*g*, which have predetermined throttle amounts, are located at the openings of the additional valve pipe lines 8*h* and 8*i*.

Manual valves 8*j* are also provided on the main valve pipe line 8*e* for selectively opening and closing the branches to the additional valve pipe lines 8*h* and 8*i*.

In this embodiment of the slow return valve 8, when the hydraulic oil flows into the hydraulic cylinder 2, the orifice 11 in the main valve pipe line 8*e* opens under the pressure of the hydraulic oil, so that the hydraulic oil can flow freely into the hydraulic cylinder.

When the hydraulic oil flows out of the hydraulic cylinder 2, on the other hand, the orifice 11 moves to cover the opening into the main valve pipe line 8*e*, and thus only the limited throttled amount can flow out of the cylinder.

The main valve pipe line 8*e* thus functions as a slow return valve with a fixed throttle amount. If the throttled main valve pipe line 8*e* were present alone, it would be necessary to replace the orifice element 11 with a differently configured one (with a different orifice) in order to change the throttle amount.

In the slow return valve 8 of FIG. 4, though, the manual valve 8*j* can be operated to open the additional valve pipe line 8*h*, thereby adding the orifice 8*f*, and thus decreasing the effective throttle amount of the combined conduits. Opening the other valve pipe line 8*i* brings into play the other orifice 8g, and if both valves are opened, both of the orifices 8f and 8g can be added simultaneously. In general, then, a choice can be made from 4 throttle amount combinations: one that employs only the orifice 11, a second with the orifice 11 plus the orifice 8f, a third that uses the orifice 11 plus the orifice 8g, and a fourth that combines the orifice 11 with both of the additional orifices 8f and 8g.

This slow return valve 8 thus allows the throttle amount to be selectively set, which enables the use of various slow return throttle amounts as appropriate for differing applications. This improves the adaptability of the unit to various uses. A simple operation is thus made available to a general user in which the throttle amount is not selected without restraint, but is instead variable among several choices made available with predetermined permissible flow rates, which improves ease of use of the overall system.

The number of the additional valve pipe lines provided with preselected orifices of the type described above may be one or more and is not limited to the two that are included in the preferred embodiment described here. The throttle amounts of the orifices may be determined in accordance with various preselected throttle amounts as appropriate, and the throttle amounts of different orifices may be different or the same.

In this embodiment the slow return valve 8 is exemplified in a construction in which the slow return function is exerted at each of the bottom side and the rod side of the hydraulic actuator 2, but the system may also be in which only one of them functions in this way, according to the requirements of any particular application.

It is also possible to use orifice elements 11 to 11E as described above in the places of the orifices 8f and 8g of the additional valve pipe lines, and in that case, the effects of those filter-integrated orifice elements would be present as well.

The filter-integrated orifice elements 11 to 11E may also be applied in a normal slow return valve with a fixed throttle amount, which is not the selective type described just above, and in that case, too, the effects of the filter-integrated orifice elements would be performed in a single body slow return valve.

Figure 5A:
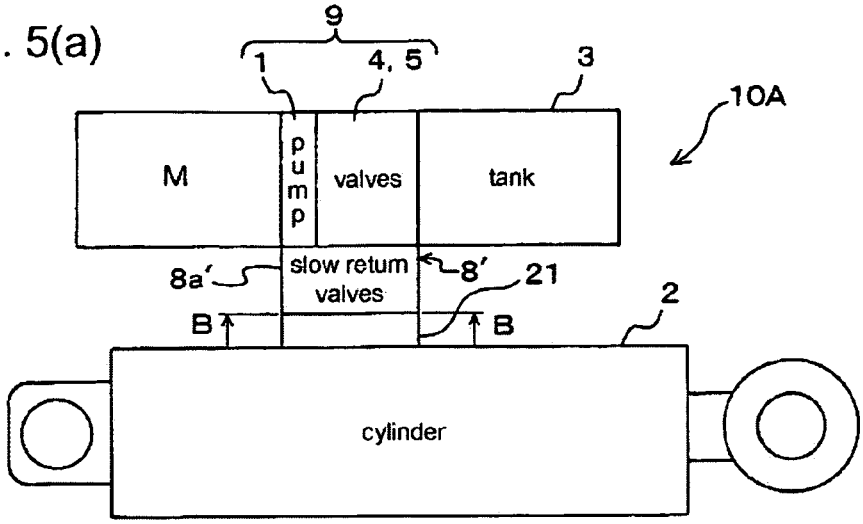
FIG. 5(*a*) is a conceptual block diagram showing another example of a hydraulic drive unit including a selective slow return valve provided with filter-integrated orifice element according to the present invention.
Figure 5B:
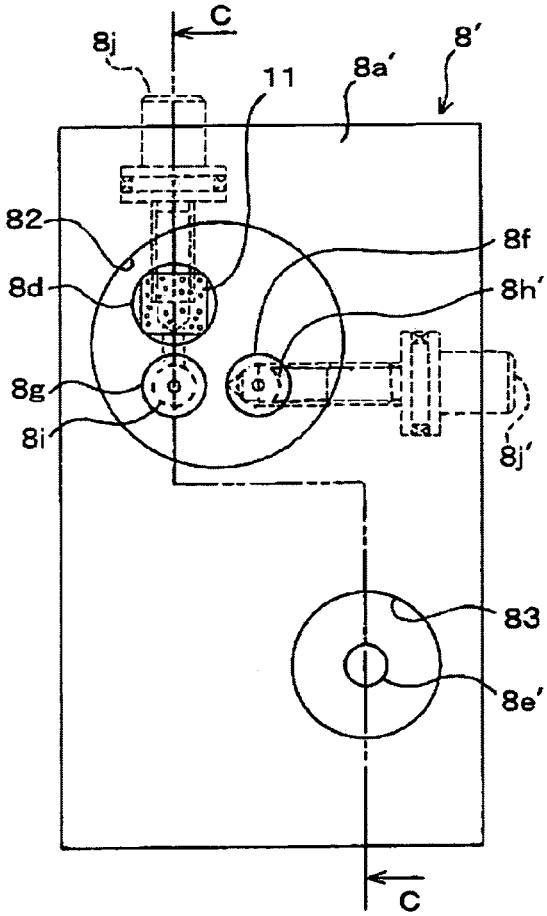
Figure 5C:
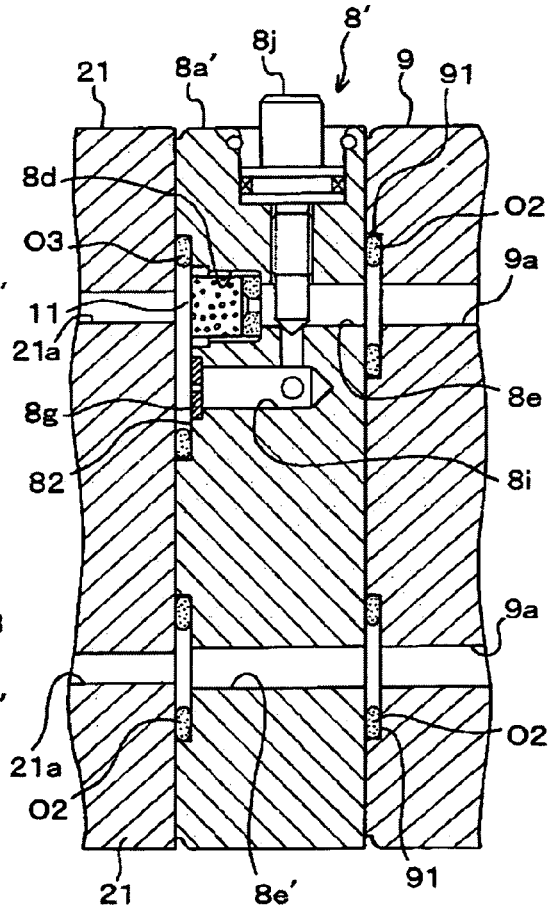

FIG. 5(a) is a conceptual block diagram showing another example of a hydraulic drive unit that include a selective-type slow return valve with a filter-integrated orifice element according to the invention. FIG. 5(b) is a section view on section line BB of FIG. 5(a), and FIG. 5(c) is a section view on section line CC in FIG. 5(b).

This hydraulic drive unit 10A is different from the hydraulic drive unit 10 in FIG. 4 in that, as FIG. 5 illustrates, an additional housing 8a' contains the parts related to a slow return valve 8'. This housing is in a structure mounted on a valve housing 9, which contains the pump 1, the operate check valve 4, and the switching valve 5.

An assembling plate 21 on the hydraulic cylinder 2 is mounted onto the housing 8a' on the side opposite the valve housing 9. The housing 8a' is thus located between the valve housing 9 and the hydraulic cylinder 2, in an assembly in which the hydraulic cylinder serves as a hydraulic actuator.

Where the system's elements are assembled together in this way, the elements' hydraulic piping is connected in an oil tight manner between the respective assembly elements without separate hydraulic piping, and the number of processes and costs for separate piping or the like can thereby be reduced.

The details of this assembly and the internal structures of the housing 8a' of this slow return valve 8' will be described in more detail with reference to FIGS. 5(b) and 5(c).

In the slow return valve assembly 8', a slow return valve is provided on only one of the bottom-side and the rod-side pipe lines described above in connection with FIG. 4—only on the rod side, in this example. Therefore, as shown in FIGS. 5(b) and 5(c), only a main valve pipe line 8e' without a restrictive orifice is provided on the bottom side in the lower parts of these figures.

On the rod side in the upper parts of FIGS. 5(b) and 5(c), on the other hand, the main valve pipe line 8e is provided with an orifice element 11, and the additional valve pipe line 8i that branches from the main valve pipe line 8e is provided with an orifice element 8g. A second additional valve pipe line 8h' that is provided with another orifice element 8f branches not from the main valve pipe line 8e, but from the first additional valve pipe line 8i.

The manual valve 8j is provided as a single part on the main valve pipe line 8e and is operable to open and close the additional valve pipe line 8i. Another manual valve 8j' is provided on the additional valve pie line 8h', and is operable to open and close this additional valve pipe line 8h' with respect to the additional valve pipe line 8i.

This embodiment enables the selection of three different degrees of throttle: (1) with the orifice element 11 only, (2) with the orifice element 11 plus the one additional orifice element 8g, and (3) with the orifice element 11 plus both of the additional orifice elements 8g and 8f. These options are selectable by opening and closing the manual valves 8j and 8j'. Although this embodiment has one fewer throttle degree selection available than in the embodiment shown in FIG. 4, a similar effect to the slow return valve 8 of that figure is nevertheless achieved.

Also, as is the case of the slow return valve 8 in FIG. 4, the filter-integrated orifice element 11 functions as a single body slow return valve.

The filter integrated orifices 11A to 11E described above may also be used in the slow return valve 8', moreover, and in that case they function in the same way as described above.

The location of the manual valve 8j in the slow return valve 8' may be changed if desired with respect to the additional housing 8a', and the size of the additional housing 8a' can thereby be reduced.

In FIGS. 5(b) and 5(c), a pipe line in the assembling plate 21 of the hydraulic cylinder 2 is indicated by reference character 21a, and a pipe line in the valve housing 9 by reference character 9a. Reference numeral 82 denotes a recess for merging the main valve pipe line 8e on the slow return valve 8' side, the first additional valve pipe line 8h' and the second additional valve pipe line 8i so that they communicate to the pipe line 21a (rod side) of the hydraulic cylinder 2 side. Reference numeral 83 denotes a recess to allow them also to communicate to the main valve pipe line 8e' on the slow return valve 8' side and the pipe line 21a (bottom side) on the hydraulic cylinder 2 side.

O-rings O3 and O2 are fitted in the above recesses 82 and 83 so as to ensure oil tightness when the additional housing 8a' of the slow return valve 8' and the assembling plate 21 of the hydraulic cylinder 2 are assembled together. A recess 91 in the valve housing 9 and an O-ring O2 perform similar functions.

The effects of the above-mentioned filter-integrated orifice elements 11 to 11E and the effect of the slow return valve provided with them are useful features in hydraulic drive units 10 and 10A in which they are used.

In the preferred embodiments described above, the filter-integrated orifice element and its various variations, the slow return valves provided with these filter-integrated orifices elements, and the hydraulic drive units provided with these slow return valves have been described. Their possible combinations are not limited to those exemplified herein, however, but other combinations are possible and in that case, the synergic effects of those combinations will be achieved.

A different hydraulic actuator, a torque-producing hydraulic rotary actuator, for example, may be used in place of the hydraulic cylinder described above to produce a driving force from hydraulic pressure.

Filter-integrated orifice elements according to the invention can be used in any industrial application where it is useful to throttle a flow rate in one of two directions, and in which small orifices are vulnerable to clogging and in which reductions in numbers and complexities of parts and assembly processes are desired.

Slow return valves provided with filter-integrated orifice elements according to the invention may used in hydraulic drive units used by general users in many diverse applications.

A hydraulic drive unit according to the invention may find use in any industrial field where such slow return valves are used to independently deliver a driving force by hydraulic pressure to a driven body, where compactness and avoidance of orifice clogging are advantageous, and where usability by general users is desired.

What is claimed is:

1. A filter-integrated orifice element comprising a filter integrated with an orifice member used in a hydraulic circuit, wherein the orifice member includes structure that defines an orifice in the orifice member, wherein the filter functions to filter obstacles which could otherwise block the orifice in the orifice member, and wherein the structural and functional strength of the orifice member is provided mainly by the structural and functional strength of the filter.

2. The filter-integrated orifice element according to claim 1, wherein the filter includes a porous body that is integrated with the orifice member after the filter is formed.

3. The filter-integrated orifice element according to claim 1, wherein the filter comprises a porous sintered body with a predetermined degree of porosity, wherein the orifice member comprises a sintered body that does not allow a hydraulic oil to pass through it, and wherein the filter and the orifice member are integrated together.

4. The filter-integrated orifice element according to claim 1, wherein the filter is provided on opposite sides of the orifice member, and on either side of the orifice.

5. A slow return valve that includes the filter-integrated orifice element according to any of claims 1, 2, 3, and 4.

6. A hydraulic drive unit that includes a slow return valve according to claim 5.

* * * * *